US005772295A

United States Patent [19]

Sundmark

[11] Patent Number: 5,772,295

[45] Date of Patent: Jun. 30, 1998

[54] CONCEALABLE STORAGE CABINET

[76] Inventor: Daniel S. Sundmark, 8 Langer Cir., West St. Paul, Minn. 55118

[21] Appl. No.: 714,378

[22] Filed: Sep. 16, 1996

[51] Int. Cl.[6] ..... A47F 5/08

[52] U.S. Cl. ..... 312/246; 312/245; 312/242; 52/32; 52/39

[58] Field of Search ..... 312/245, 246, 312/247, 204, 248, 237, 242, 243, 329, 249.7, 334.12, 330.1, 334.42; 52/32, 39, 29, 36.1, 36.4, 36.5; 211/64

[56] References Cited

U.S. PATENT DOCUMENTS

| | | | |
|---|---|---|---|
| 3,627,397 | 12/1971 | Rominsky | 312/246 |
| 3,627,398 | 12/1971 | Reese | 312/246 |
| 4,193,649 | 3/1980 | Sharon | 312/334.21 X |
| 4,285,557 | 8/1981 | Paladino et al. | 312/246 |
| 4,446,660 | 5/1984 | Miller et al. | 312/245 X |
| 4,699,437 | 10/1987 | Genereaux | 312/246 X |
| 5,242,219 | 9/1993 | Tomaka | 312/245 |
| 5,329,865 | 7/1994 | McWard | 312/242 X |
| 5,460,280 | 10/1995 | Feddeler | 312/248 X |
| 5,484,198 | 1/1996 | Pilliod | 312/330.1 X |
| 5,595,028 | 1/1997 | Handzlik | 312/245 X |

*Primary Examiner*—Peter M. Cuomo
*Assistant Examiner*—James O. Hansen
*Attorney, Agent, or Firm*—Jacobson & Johnson

[57] ABSTRACT

A storage cabinet for guns or the like wherein the storage cabinet includes rollers for pivotingly suspending the storage cabinet on a set of tracks located between adjacent joists so that the storage cabinet can be swung from a first accessible position where one can access the contents of the storage cabinet to a second inaccessible position. In the inaccessible position, the gun-storage cabinet can be slid to an out-of-sight overhead space defined by adjacent joists to hinder access to the storage cabinet as well as to conceal the gun-storage cabinet from view.

6 Claims, 5 Drawing Sheets

CONCEALABLE STORAGE CABINET

FIELD OF THE INVENTION

This invention relates to storage cabinets and, more specifically, to a gun-storage cabinet that can be stowed in a concealed condition within a space between adjacent joists when not in use and swung out of the space when one needs access to the contents of the storage cabinet.

BACKGROUND OF THE INVENTION

The art is replete with various types of storage cabinet for guns. The gun-storage cabinets, which are usually a locked, upright cabinet, are necessary to prevent small children and others from gaining access to the guns in the storage cabinet. One of the disadvantage of such cabinets is that they are present as a reminder to children and others that guns are in the cabinet.

Gun cabinets are also visible targets for thieves who break into the home. The present invention comprises a storage cabinet that can be suspended and concealed between building joists and can be swung from an accessible position which enables access to the storage cabinet to a inaccessible position where the storage cabinet is located in an out-of-sight space between adjacent joists.

SUMMARY OF THE INVENTION

A storage cabinet for guns or the like wherein the storage cabinet includes rollers for pivotingly suspending the storage cabinets on a set of tracks located between adjacent joists, so that the storage cabinet can be swung from a first accessible position where one can access the contents of the storage cabinet to a second inaccessible position. In the inaccessible position, one can slid the gun-storage cabinet to an out-of-sight overhead space defined by adjacent joists to hinder access to the storage cabinet as well as to conceal the gun-storage cabinet from view.

DESCRIPTION OF THE PREFERRED EMBODIMENT

Figure 1:
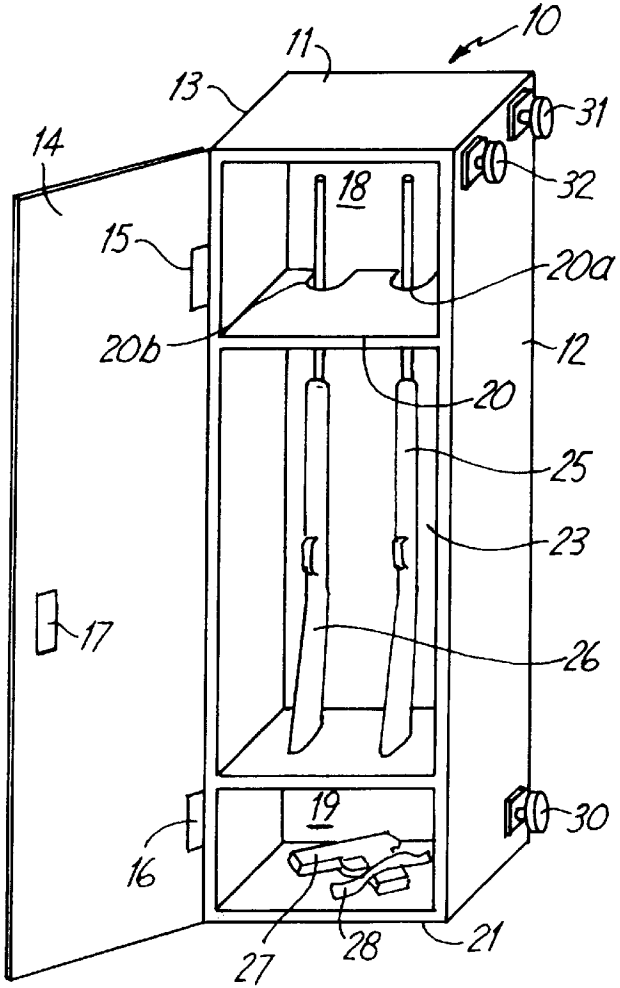
FIG. 1 is a perspective view of the gun-storage cabinet of the present invention with the storage cabinet containing guns therein.

FIG. 1 is a perspective view of the gun-storage cabinet 10 of the present invention, with the storage cabinet containing guns 25, 26 and 27 therein. Gun-storage cabinet 10 is a rectangular wood cabinet, having a top 11, a bottom 21 and a first side wall 12 and a second side wall 13.

A back 23 closes the rear of cabinet 10 and a door 14 having a first hinge 15 and a second hinge 16 permits a user to open and close gun-storage cabinet 10. A latch or lock 17 is in door 14 which permits locking the gun cabinet.

Located within compartment 18 in gun cabinet 10 is a gun holder 20, having notches 20*a* and 20*b* for holding guns 25 and 26 in position. Similarly, a fastener 28 in compartment 19 holds a pistol 27 therein. Located on side wall 12 is a first roller 31 which extends laterally outward from gun cabinet 10. Similarly, an identical roller (not shown) extends laterally outward from gun cabinet 10. While the gun cabinet is made of wood, if preferred the gun cabinet could be made of metal or other similar materials.

Figure 3:
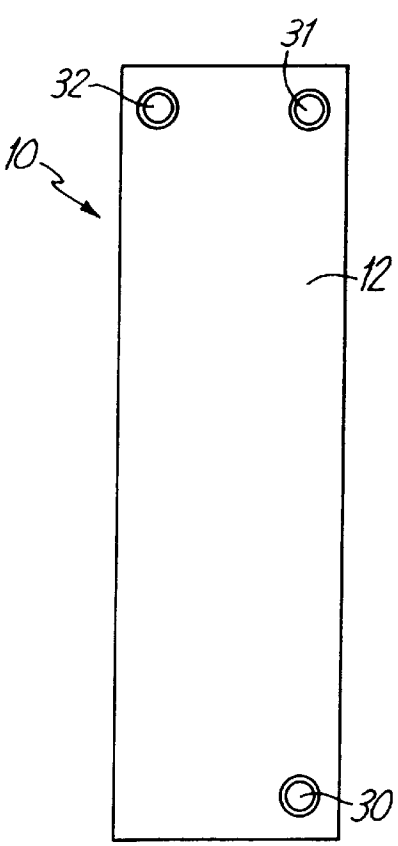
FIG. 3 is a side view of the gun-storage cabinet of FIG. 1.
Figure 2:
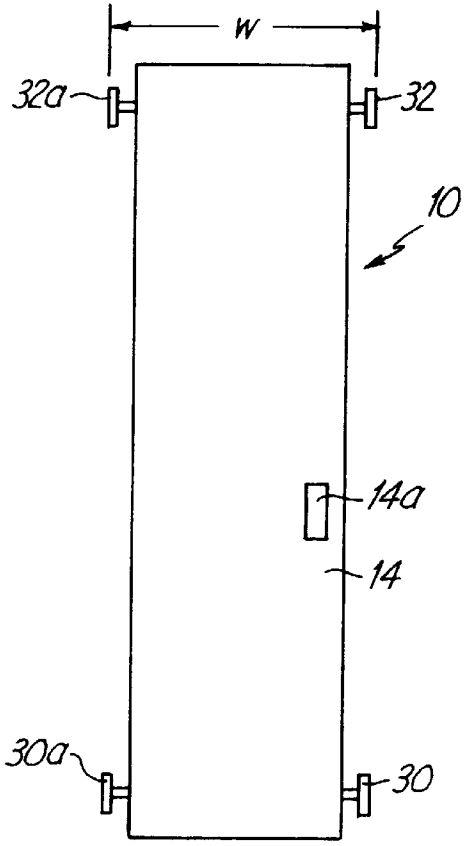
FIG. 2 is a front view of the gun-storage cabinet of FIG. 1.

Reference to FIG. 3 shows that gun cabinet 10 includes rollers 32 and 32*a* which are located on opposite sides of gun cabinet 10. Similarly, located at the bottom of gun cabinet 10 is a a set of rollers 30 and 30*a*. While various rollers could be used I prefer conventional type of rollers used with overhead garage doors.

Figure 4:
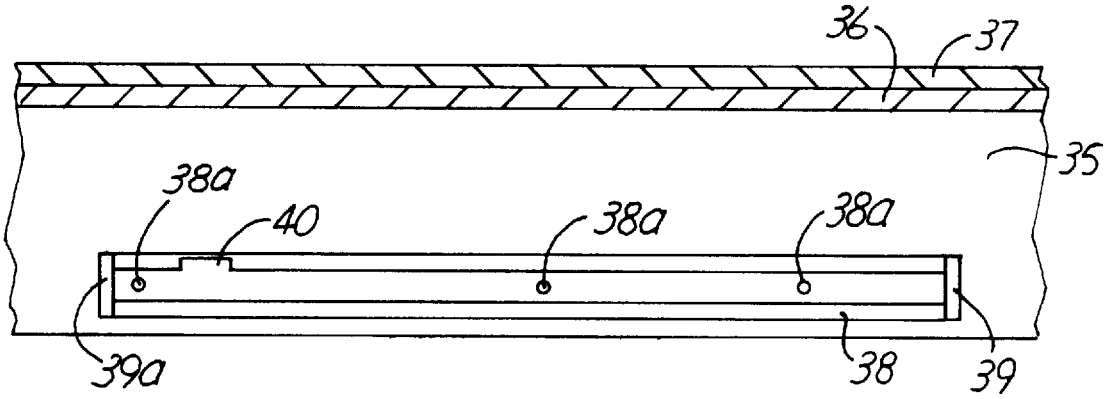
FIG. 4 is a partial side view of a joist with a track for pivotally supporting the gun-storage cabinet of FIG. 1 therefrom.
Figure 5:
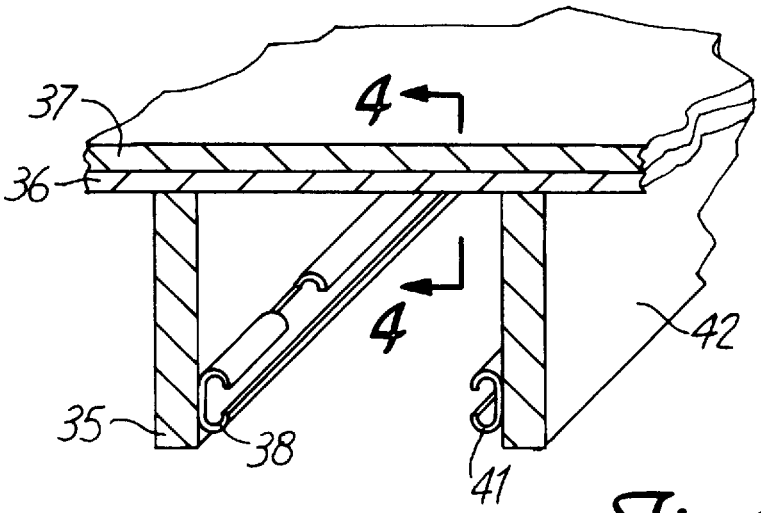
FIG. 5 is a partial perspective view of an adjacent joist with tracks for supporting the gun cabinet of FIG. 1 therefrom.

FIG. 4 is a sectional view taken along lines 4—4 of FIG. 5. FIG. 4 shows a partial side view of a joist 35 with a track 38 for pivotingly supporting gun-storage cabinet 10 therefrom. Joist 10 could be a floor joist in a basement or a ceiling joist in the house. Located on top of joist 10 is a subfloor 36 with a carpet 37 thereon. Track 38 is a straight section of a conventional garage door track with the track secured to the face of joist 35 with lag bolts 38*a*. Track 38 includes a stop 39 to prevent the gun cabinet from rolling off track 38. Similarly, a front stop 39*a* prevents the gun cabinet from rolling off the other end of track 38. Track 38 includes a roller opening 40 to facilitate placement or removal of the roller in track 38 from track 41.

FIG. 5 is a partial perspective view of adjacent joists 35 and 42 with a first track 38 on joist 35 and a second track 41 secured to joist 42. Joists 35 and 41 are located in a spaced apart parallel condition with tracks 38 and 41 located on the lower face of the joists.

Figure 6:
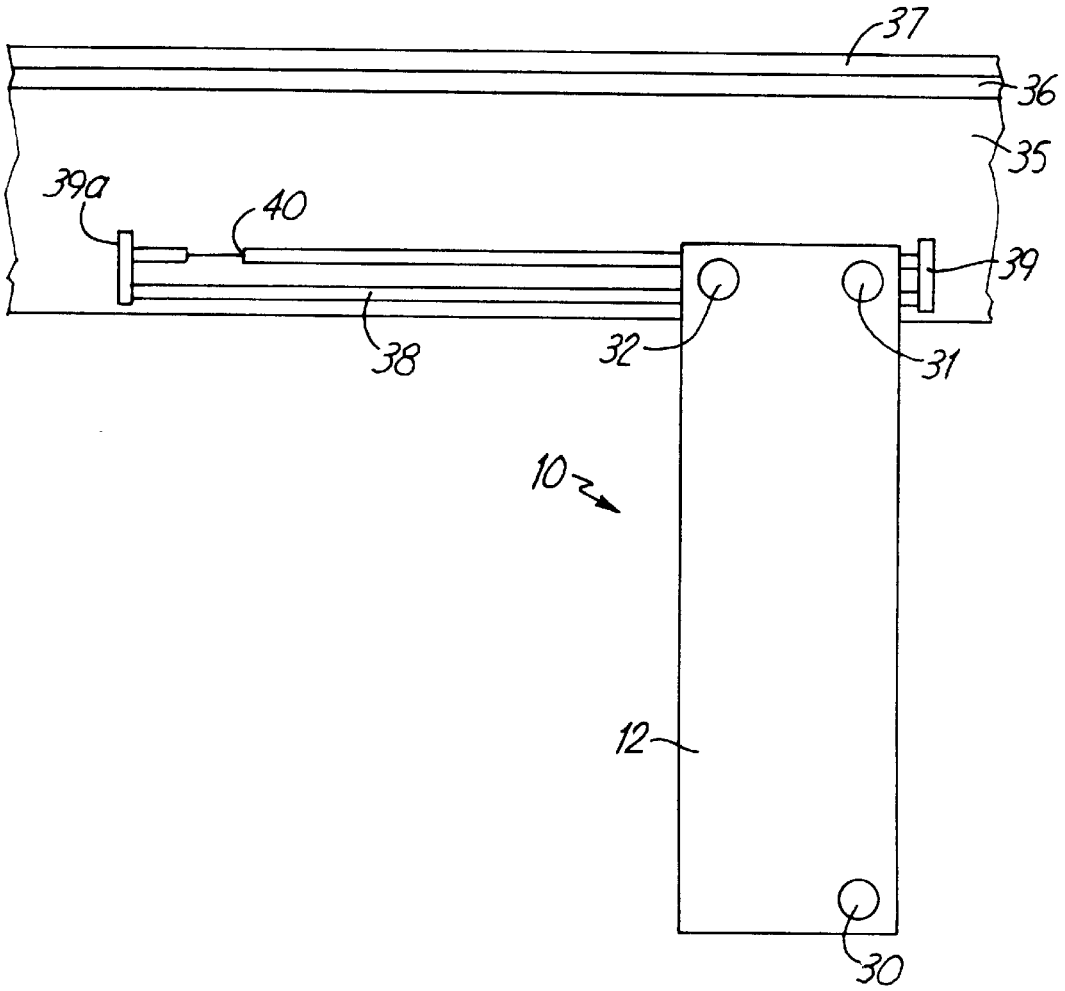
FIG. 6 is a side view of the gun-storage cabinet of FIG. 1 hanging from a track located on one of a pair of spaced apart joists hanging from a track located on a pair of spaced apart joists.

FIG. 6 is a side view of the gun-storage cabinet 10 suspended from joist 35 to illustrate suspension of gun cabinet 10 in a vertical position from track 38 located on one of a pair of spaced apart joists. Rollers 31 and 32 on the opposite side would correspondingly engage track 41 on joist 42 (FIG. 5).

Figure 7:
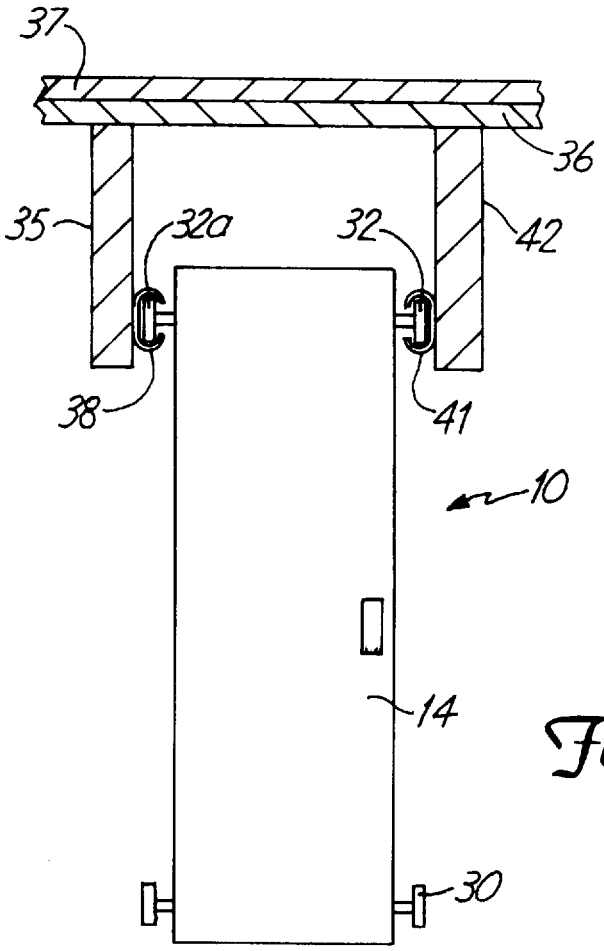
FIG. 7 is a front view of the gun-storage cabinet in the vertical condition

FIG. 7 is front view of the gun-storage cabinet 10 hanging in a vertical position from track 38 located on joist 35 and track 41 located on joist 42. This condition enables one to access the gun-storage cabinet door 14 in gun-storage cabinet 10.

Figure 8:
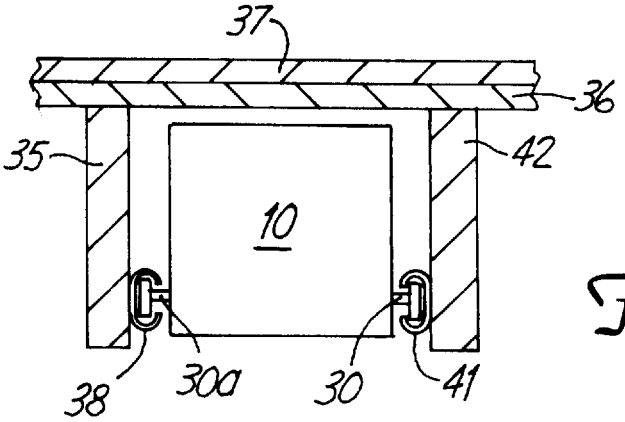
FIG. 8 shows the gun-storage cabinet of FIG. 7 in the stowed position with the gun-storage cabinet located entirely in the space defined by adjacent joists.

FIG. 8 shows the gun-storage cabinet 10 in the stowed position with the gun-storage cabinet 10 located in a horizontal position and the gun cabinet located entirely in the space defined by adjacent joists 35 and 42. That is, a false ceiling panel now covers gun cabinet 10 so that no one can tell that the gun-storage cabinet is located between the joists.

Figure 9:
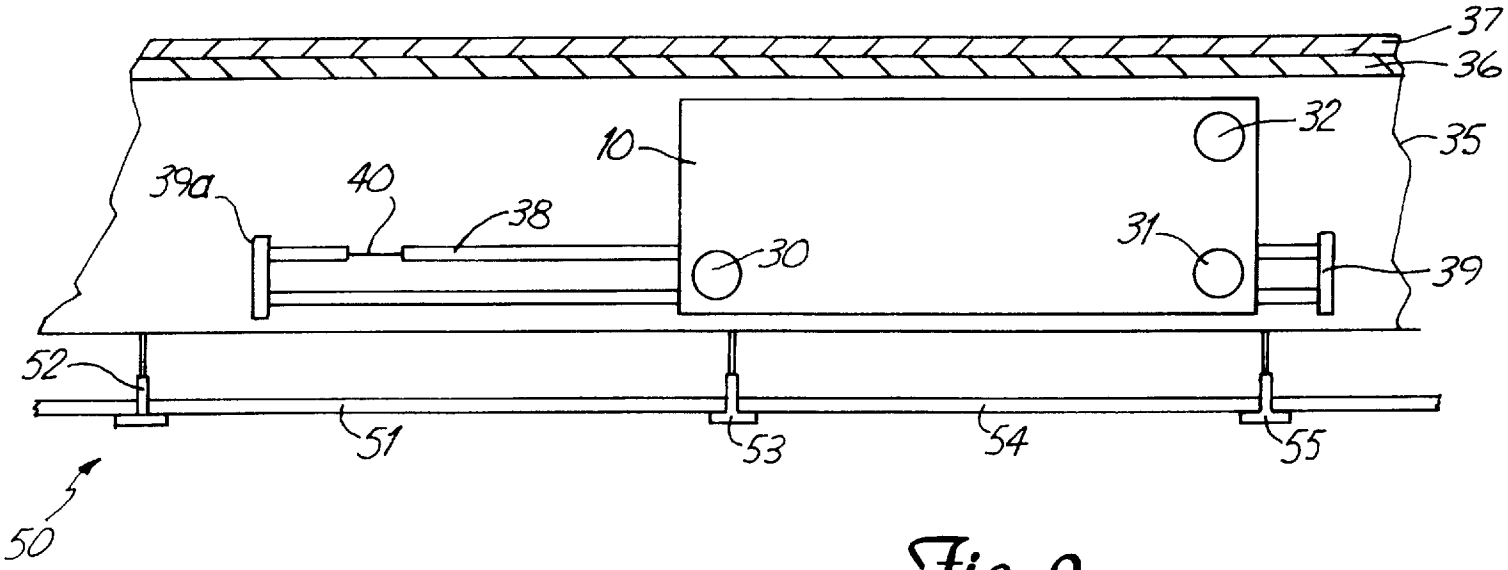
FIG. 9 shows a cross-sectional view of the gun-storage cabinet located between adjacent joists that are concealed by a false ceiling.

FIG. 9 shows a cutaway view of gun storage rack 10 held on track 38. A similar track 41 holds the opposite side of gun storage rack 10, but for purposes of illustration, the positioning of the cabinet it is not shown. Located below joist 35 is a false ceiling 50 which is suspended from joist 35 by tees 52, 53 and 55. One can remove panel 51 from tees 52 and 53, so he or she can access gun cabinet 10. That is, by removing panel 51, one can slide gun cabinet 10 forward on track 38 to the vertical position. Once the user is done with the gun cabinet, he or she can swing it to the horizontal position and slide it backward on track 38 to an out-of-sight position. For example, the gun cabinet could be slid to a compartment located over other furniture so that the gun cabinet would be out of the way.

To illustrate the operation of the invention, reference should be made to FIG. 8 which shows gun cabinet 10 in a stowed condition. In this condition, the back rollers 30, 31 and their counterparts 30*a* and 31*a* support the gun cabinet on tracks 38 and 41 in a horizontal condition.

Referring to FIG. 9, one slides the gun cabinet 10 until the roller 30*a* is in alignment with top opening 40, and the corresponding roller 30 is in alignment with a corresponding opening (not shown) on track 41. The user can then lift the end of gun compartment to disengage rollers 30 and 30*a* from their tracks. By continuing to slide gun cabinet forward, rollers 30 and 30*a* clear stop 39*a* and the corresponding stop on track 41. This allows one to swing the end of the gun cabinet down so gun cabinet 10 hangs in the vertical position as shown in FIG. 6. Swinging down the end of the gun cabinet engages roller 32 and its counterpart 32*a* with track 38 and 41, thereby maintaining the vertical position of the gun cabinet, or, if desired, a slightly off-vertical condition. Using two sets of top rollers prevents the gun cabinet from swinging. That is, coaction of the rollers 31, 32, 31*a* and 32*a* and tracks 38 and 41 allows lateral movement of the gun cabinet along the track and prevents gun cabinet from swinging to and fro on the track.

To store the gun cabinet, one reveres the process by first disengaging rollers 32 and 32*a* by lifting the lower end of the gun cabinet when the rollers are in alignment with the top openings in track 38 and 41. Next, one engages the lower rollers 30 and 30*a* by inserting them in the top openings in track 38 and 41. After engaging rollers 30 and 30*a,* one can roll the gun cabinet to a storage condition between adjacent joists.

I claim:

1. In combination:

a first joist and a second joist with said first joist and said second joist located in a spaced apart condition and defining a space therebetween;

a first elongated track extending along said first joist, said first elongated track having a bottom portion forming a roller support;

a second elongated track extending along said second joist, said second elongated track having a bottom portion forming a roller support;

a cabinet for storing articles therein, said cabinet having a top and a bottom, said cabinet having a first side and a second side, said cabinet having a door therein, said cabinet sufficiently narrow for mounting in a horizontal condition in the space between said first joist and said second joist with said cabinet having a length sufficiently shorter than said elongated tracks;

a first set of top rollers, said set of top rollers located on opposite sides of said cabinet, said first set of top rollers engageable with said first elongated track and said second elongated track to permit moving of said cabinet along said first elongated track and said second elongated track, said first set of top rollers disengageable from said elongated tracks by pivoting said cabinet;

a second set of top rollers spaced from said first set of top rollers, said second set of top rollers located on opposite sides of said cabinet with said first set of top rollers and said second set of top rollers simultaneously engageable with said tracks for movably supporting said cabinet in a vertical condition whereby the door in said cabinet can be opened or closed to allow placement of articles in or to allow removal of articles from said cabinet;

a set of bottom rollers, said set of bottom rollers located on opposite sides of said cabinet, said set of bottom rollers engageable and disengageable with said tracks, said set of bottom rollers cooperating with said second set of top rollers so that when said first set of top rollers is disengaged from said tracks said set of bottom rollers and said second set of top rollers can simultaneously engage said track to enable said second set of top rollers and said bottom rollers to hold said cabinet in a horizontal condition whereby said second set of top rollers and said bottom rollers permit said cabinet to be horizontally moved along said track to an out-of-the-way condition and in the event access to the cabinet is needed, said set of bottom rollers disengageable from said track to enable the cabinet to be swung from a horizontal condition where the cabinet is located within a space defined between the first and the second joist to a vertical hanging position wherein said first set of top rollers is engageable with said track so that said first set of top rollers and said second set of top rollers hold said cabinet in a vertical condition so articles can be placed in or removed from said cabinet.

2. The combination of claim 1 wherein the cabinet is made of wood.

3. The combination of claim 1 wherein the cabinet includes a plurality of storage compartments therein.

4. The combination of claim 1 wherein when said cabinet is located in the horizontal condition with the entire cabinet is located in the space defined by said first joist and said second joist.

5. The combination of claim 1 wherein the cabinet includes holders for long guns.

6. The combination of claim 1 wherein said tracks includes a top portion for maintaining the rollers in said tracks with said top portion including a top opening therein for engaging or disengaging one of the set of rollers therefrom.

* * * * *